US005944408A

United States Patent [19]

Tong et al.

[11] Patent Number: 5,944,408

[45] Date of Patent: Aug. 31, 1999

[54] DECORATIVE LIGHTING ASSEMBLY HAVING REINFORCED, TIED NODE

[76] Inventors: George Tong, 11-15 Chai Wan Kok Street; Wai-Lung Wong, 1/F., Mandarin Ind Bldg., 11-15 Chai Wan Kok St., both of Tsuen Wan, New Territories, The Hong Kong Special Administrative Region of the People's Republic of China

[21] Appl. No.: 09/016,496

[22] Filed: Jan. 30, 1998

[51] Int. Cl.[6] ..... F21P 1/00

[52] U.S. Cl. ..... 362/252; 362/391; 362/806

[58] Field of Search ..... 362/123, 249, 362/252, 806, 391

[56] References Cited

U.S. PATENT DOCUMENTS

| | | | |
|---|---|---|---|
| 3,096,943 | 7/1963 | Forrer . | |
| 4,713,586 | 12/1987 | Chiang | 315/200 A |
| 4,720,773 | 1/1988 | Ahroni | 362/249 |
| 4,736,282 | 4/1988 | Ahroni | 362/123 |
| 4,870,547 | 9/1989 | Crucefix | 362/123 |
| 5,057,976 | 10/1991 | DuMong | 362/123 |
| 5,213,519 | 5/1993 | Dorfman | 439/505 |
| 5,338,585 | 8/1994 | Fraus et al. | 428/18 |
| 5,424,925 | 6/1995 | Jenke et al. | 362/123 |
| 5,601,361 | 2/1997 | Lawrence | 362/238 |
| 5,632,550 | 5/1997 | Yeh | 362/123 |
| 5,639,157 | 6/1997 | Yeh | 362/123 |
| 5,662,409 | 9/1997 | Huang | 362/249 |
| 5,667,295 | 9/1997 | Tsui | 362/252 |
| 5,669,707 | 9/1997 | Huang | 362/249 |
| 5,716,124 | 2/1998 | Hsu | 362/252 |
| 5,747,940 | 5/1998 | Openiano | 315/185 S |
| 5,800,046 | 9/1998 | Lin | 362/252 |

OTHER PUBLICATIONS

3 Photographs "Sparkle Net Light"—Action Lightÿ, Bozeman, Montana, Jan. 1994.

*Primary Examiner*—Stephen Husar

*Attorney, Agent, or Firm*—Lockwood, Alex, Fitzgibbon & Cummings

[57] ABSTRACT

A decorative lighting assembly has the form of a grid or lattice in which a plurality of wires form a baseline and first and second branches of the assembly. The second wire branches intersect with both the baseline and first wire branches at nodes of the assembly. Light sockets are connected to selected wires of the nodes. The wires and light sockets are maintained in place at their respective nodes by enclosing at least some of the intersecting wires with a tying wire and forming a knot in the wire proximate to the light socket so that the knot and light socket are inhibited from significant movement relative to each other.

25 Claims, 4 Drawing Sheets

DECORATIVE LIGHTING ASSEMBLY HAVING REINFORCED, TIED NODE

BACKGROUND OF THE INVENTION

The present invention relates generally to decorative lighting, and more particularly to arrays of lights arranged in a grid, lattice or other pattern.

Conventional Christmas lighting utilize a plurality of individual lights that are arranged in serial order in a predetermined spacing along the length of one or more wires. Each such light includes a plurality of sockets and a plurality of corresponding lights that are received within the sockets Such light arrays may be referred to in the art as light "strings". These light strings may terminate at one or more ends thereof in electrical plugs or receptacles which are used to connect the light strings to a source of electrical power or to connect to additional light strings. These string lights are typically applied to Christmas trees and structures by hanging or winding them around a support structure, such as a Christmas tree.

Although light strings appear decorative when mounted in such a manner on a tree, it is difficult to uniformly arrange the lights in a pleasing pattern. Additionally, the winding process is tedious and often may result in broken branches and tree needles. When removed from a support structure, the light strings must then be wound in a coil and tangling may result during their removal.

In order to overcome these problems, light "grids" have been developed to facilitate the arrangement and mounting of decorative lights on support structures, such as Christmas trees. For the most part, these light grids are expensive to construct or are flimsy in construction. U.S. Pat. No. 5,424,925 issued Jun. 13, 1995 describes a decorative lighting system in which pairs of electrical wires are laid out in a grid pattern on top of and attached to a separate grid structure. The use of these second structure increases the complexity of manufacture of such a light grid, which results in an increase in the cost of manufacture of such a light grid.

U.S. Pat. No. 5,645,342, issued Jul. 8, 1997 describes a decorative light grid in which singles wires are joined to individual light sockets at nodal points of the light grid. This grid includes a plurality of nodes that include individual light sockets. The nodes are formed by joining certain wires to the light sockets by binding the wires to the sockets with adhesive tape or plastic sleeves. If the bands that join the wires to the sockets are broken, the node is destroyed and the wires come apart. Additionally, when single wires are used to join the light sockets together, the single wires may not be able to resist stress induced from repeated placements on and removal from support structures.

The present invention is directed to a decorative light assembly that overcomes the disadvantages of the aforementioned prior art and which utilizes wires that are tied together at the nodes of the lighting assembly to substantially prevent movement of the light sockets away from the nodes and to increase the strength of the light assembly.

SUMMARY OF THE INVENTION

Accordingly, it is a general object of the present invention to provide an improved light assembly for use in decorative lighting applications.

Another object of the present invention is to provide a decorative light assembly that may be easily draped over support structures and which light assembly includes a series of branches that intersect together to define nodes of the assembly, and wherein the light assembly utilizes wires of relatively small gauge for the branches of the assembly, but which are doubled and twisted to increase the strength of the assembly branches.

Still another object of the present invention is to provide a decorative lighting assembly in the form of a lattice, the lattice having a baseline and a series of first and second wire branches that are interconnected together at nodes of the lattice, the wires of the branches intertwined together at the nodes and proximate to the light sockets positioned at the nodes so as to prevent shifting and movement of the nodes.

Yet another object of the present invention is to provide a decorative light grid assembly in which a plurality of lights and corresponding sockets are positioned at a plurality of individual nodes of the grid assembly, the grid assembly including a plurality of pairs of wires twisted together lengthwise of themselves that lead into and out of the grid assembly nodes, pairs of wires defining separate branches of the grid assembly, certain branches defining restraining other branches of the nodes from moving relative to the associated light sockets.

These objects are accomplished by at least one principal aspect of the present invention in which the light grid assembly includes a baseline having an electrical plug disposed thereon and a plurality of branches, a first set of the branches extending parallel to the baseline and a second set of the branches intersecting the baseline and the first branches, wherein at each such intersection, some of the wires that make up the first and second branches and baseline are tied together to define nodes of the light grid assembly.

In another principal aspect of the present invention, the first, second and baseline wires are intertwined together at the nodes and at least one wire entering the nodes is tied together proximate to the light socket of the node in a manner such that wires of each node are prevented from substantially moving away from the light socket of each respective nodes.

In still yet another principal aspect of the present invention, the wires that make up the baseline, first and second branches are of a relatively small gauge, such as 22 gauge and are twisted together to provide strength to the baseline and first and second branches.

Yet still another principal aspect of the present invention resides in the placement of a knot near a light socket within a node in a manner in which the knot is prevented from easily moving away from the node driving installation of the light assembly. The use of such knots permit the light assembly to be fabricated in different geometric configurations, such as square, rectangular, triangular, octagonal, semi-circular or the like.

Yet another principal aspect of the present invention resides in the use of wire pairs for the first and second branches and in the positioning of light sockets at the nodes of the grid assembly defined at the intersection of the first and second branches. At least one live and return wire enter each light socket, the live and return wires entering the light socket from different directions, and preferably respectively along axes of the first and second branches.

These and other objects, features and advantages of the present invention will become apparent from the following detailed description, taken in conjunction with the accompanying drawings, wherein like reference numerals refer to like parts.

BRIEF DESCRIPTION OF THE DRAWINGS

In the course of the following detailed description, reference will be frequently made to the accompanying drawings in which.

DETAILED DESCRIPTION OF THE INVENTION

Figure 1:
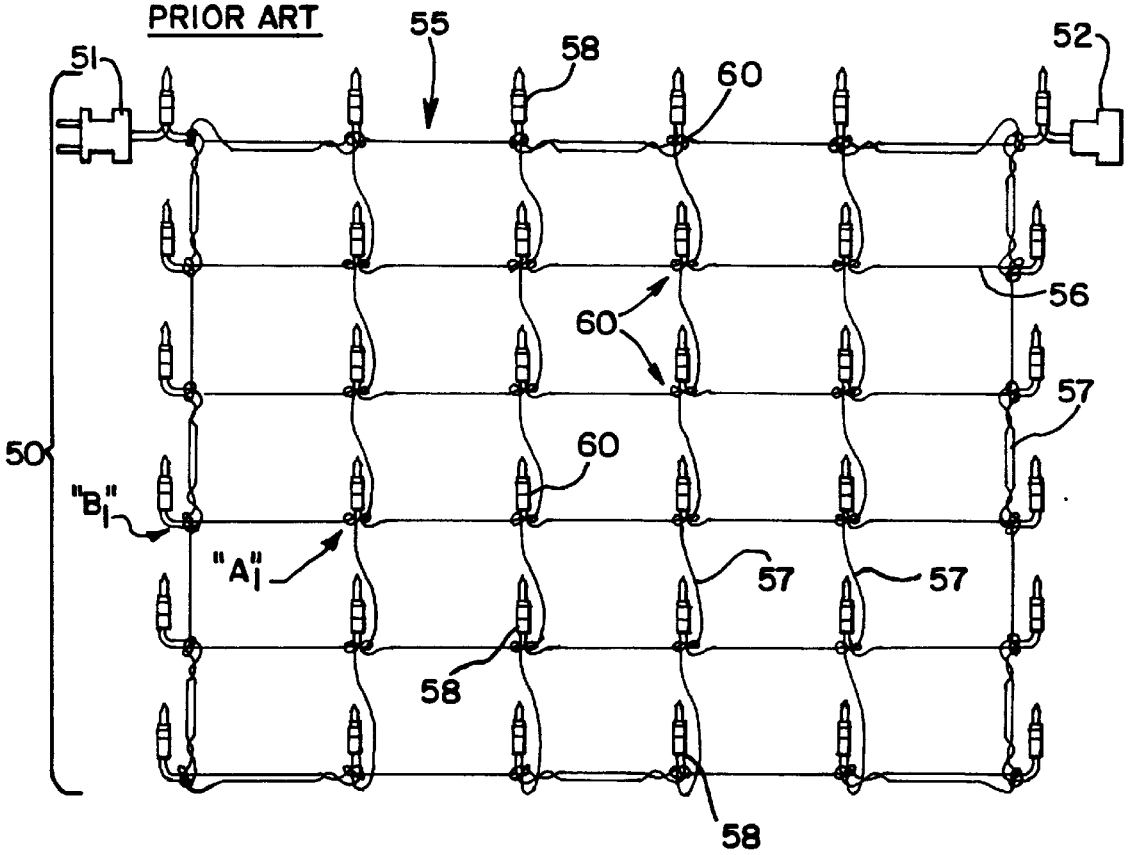
FIG.1 PRIOR ART
FIG. 1 is a plan view of a known light grid assembly.

Referring to FIG. 1, a known light grid assembly developed by the owner of the present invention is designated generally at 50 and is illustrated as if hung vertically on a support surface. This grid assembly has an electrical plug 51 disposed at one end thereof for connecting to a source of electrical power, such as an outlet. At an opposite end thereof, the grid assembly has an electrical receptacle 52 for receiving the plug of another such grid assembly.

The grid assembly 50 may be considered as having a baseline 55 that extends between the plug 51 and receptacle 52. The grid assembly 50 further has respective first branches 56 and second branches 57 that are arranged in a rectangular grid-like pattern as illustrated in FIG. 1. The first branches 55 extend generally parallel to the baseline 55 illustrated as generally horizontal in FIG. 1, while the second branches 57 extend at an angle to both the baseline 55 and the first branches 56 and preferably generally perpendicular thereto, and illustrated in FIG. 1 as generally vertical.

A plurality of decorative lights 58 are arranged on the grid light assembly 50 and are disposed at what may be considered as nodes 60 of the grid. Each such light includes a light bulb assembly 62 and a socket 63. Electrical current is fed to each light bulb assembly 62 by what may be considered as live and return wires 65, 66. In the drawing Figures, a conventional electrical notation is used and thus the "live" or feed wire 65 of each socket is shown in solid black, while the return wire 66 is shown in solid white. Additional wires entering and leaving the nodes are shown in this description with stippling, dashes or stripes.

Figure 2:
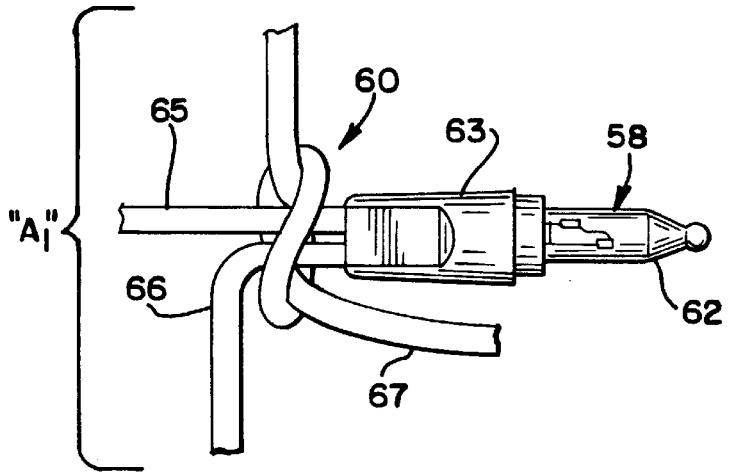
FIG.2 PRIOR ART
FIG. 2 is an enlarged detail view of one of the interior nodes designated at $A_1$ in the known light assembly of FIG. 1.
Figure 3:
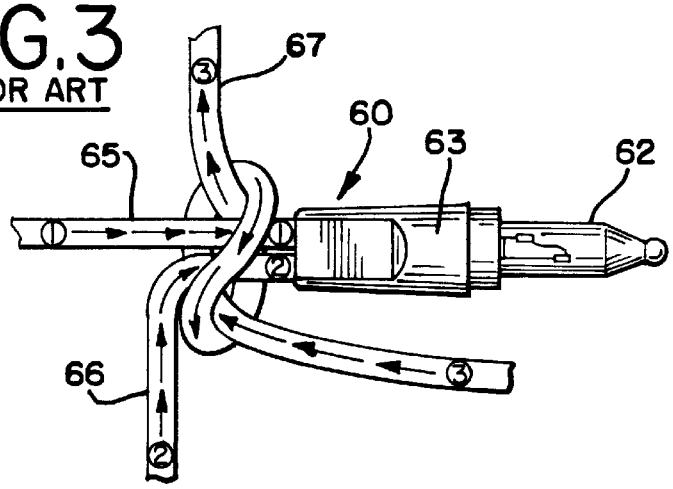
FIG.3 PRIOR ART
FIG. 3 is a diagrammatic view of FIG. 2, illustrating the direction of travel of each of the wires forming the interior node $A_1$ thereof.
Figure 4:
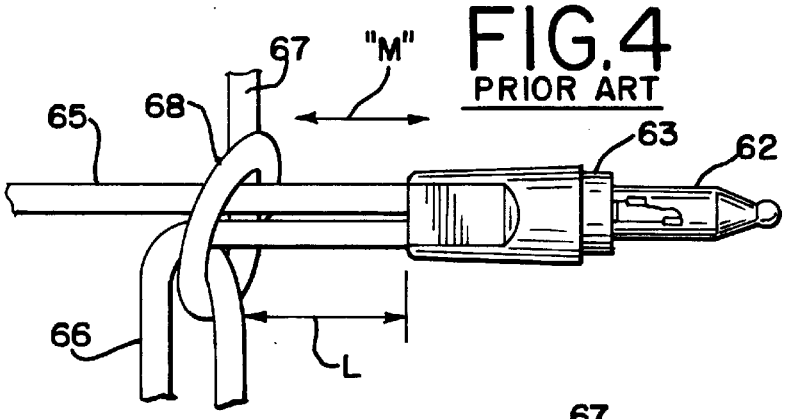
FIG.4 PRIOR ART
FIG. 4 is the same view as FIG. 2, but illustrating the movement of the intersecting wires of the interior node relative to the live and return wires of the light socket associated with the interior node $A_1$.
Figure 5:
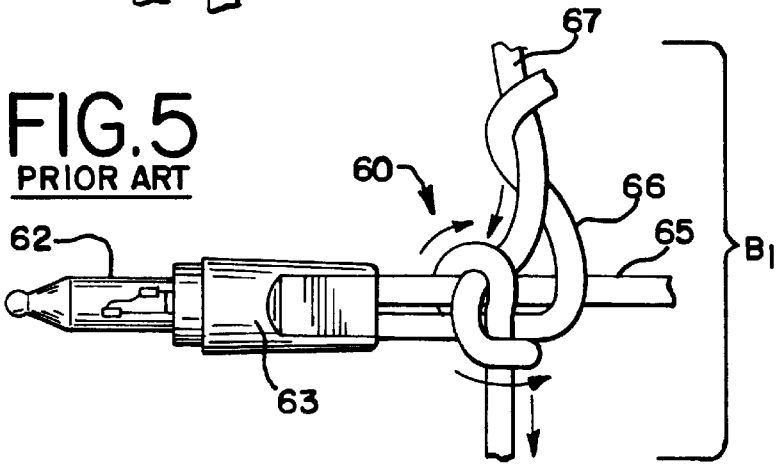
FIG.5 PRIOR ART
FIG. 5 is an enlarged detail view of one of the exterior nodes designated at $B_1$ in the known light assembly of FIG. 1.
Figure 6:
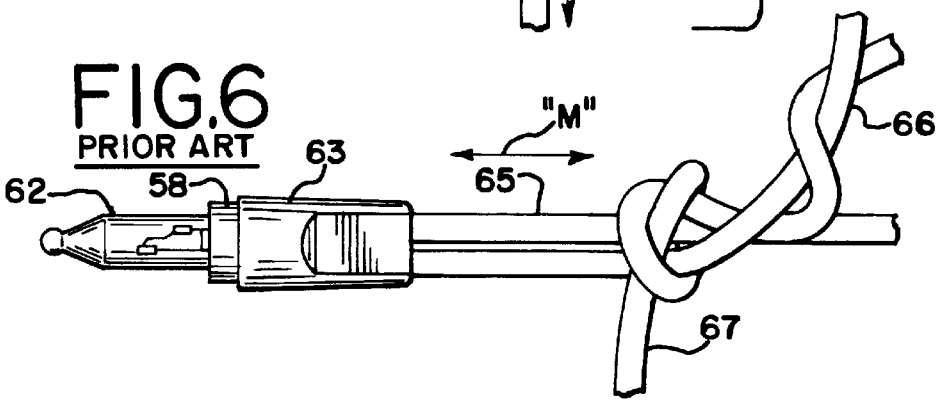
FIG.6 PRIOR ART
FIG. 6 is the same view as FIG. 5, but illustrating the movement of the intersecting wires of the exterior node relative to the live and return wires of the light socket associated with the exterior node $B_1$.

In this known grid light assembly 50, a single additional wire 67 is shown with a stippled pattern and this additional wire 67 is used to interconnect one node with another node. The intersection of these three wires 65, 66 & 67 at an interior node $A_1$ is best illustrated in FIGS. 2 through 4. In FIG. 2, the live wire 65 is shown entering a light socket 63 from the side, while the return wire 66 is shown exiting the socket 63 and extending down to the next light socket. A third wire 67 which may be considered as one interconnecting the nodes together is illustrated as extending into the node 60 from the right of FIG. 2, where it is knotted in an overhand knot 68 around the live and return wires 65, 66 and then exits up toward another node of the lighting grid 50.

FIG. 3 illustrates diagrammatically how the additional wire 67 is knotted around the live and return wires 65, 66. In this Figure, the live wire 65 is identified as "1", the return wire 66 is identified as "2", while the additional wire 67 is identified as "3" along their respective wires lengths for clarity in understanding how the wires are connected. By virtue of the simple overhand knot 68 that surrounds only the two wires 65 & 66, the additional wire 67 is capable of sliding along the longitudinal axis of the live wire 65 in the directions indicated in FIG. 4 by the arrow M. Due to this movement, it will be recognized that the knot 68 will not secure all of the wires together at the node 60, but rather, the knot 68 is capable of a significant movement L along this axis. This movement is detrimental to the application of the grid light assembly 50, for such sliding may occur when a user is installing the grid light assembly 50 when one or more third wires 67 are pulled during installation, thereby necessitating readjustment and realignment of the lighting grid 50.

Apart from the inconvenience of the movement of the third wires 67 of the aforementioned grid light assembly 50, a new Underwriters Laboratory ("UL") standard, No. 588, has recently been issued for decorative lighting assemblies. This standard requires that any such decorative lighting assembly use a heavier gauge wire, such as 20 or 18 gauge, in order that the grid light assembly 50 has sufficient strength to withstand repeated or rough installations. The use of larger gauge wires increases the cost of the grid light assembly.

UL standards do permit the use of smaller gauge wire for decorative lighting assemblies, such as 22 gauge wire. However, UL standards require that such gauge wires be twisted a certain minimum numbers of turns per inch in order to impart a greater strength to the wires. The present invention is therefore directed to a novel decorative lighting assembly that avoids the slippage that occurs with the known lighting assembly of FIG. 1.

Figure 7:
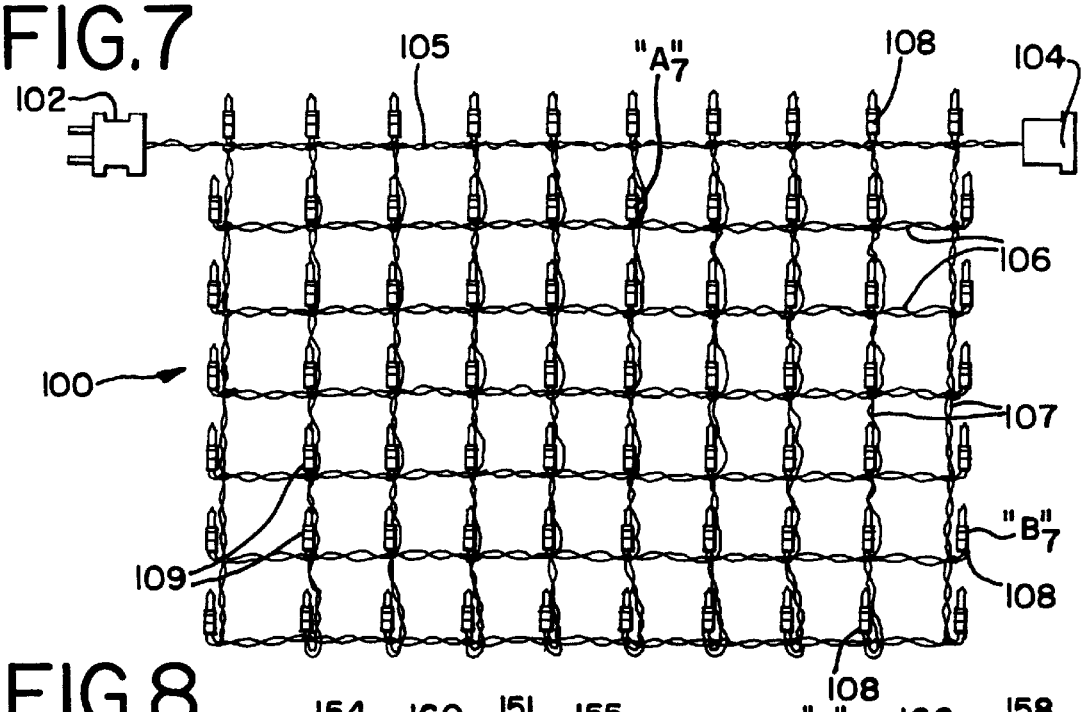
FIG. 7 is a plan view of a first embodiment of a light assembly constructed in accordance with the principles of the present invention and illustrated as having a rectangular configuration.
Figure 8:
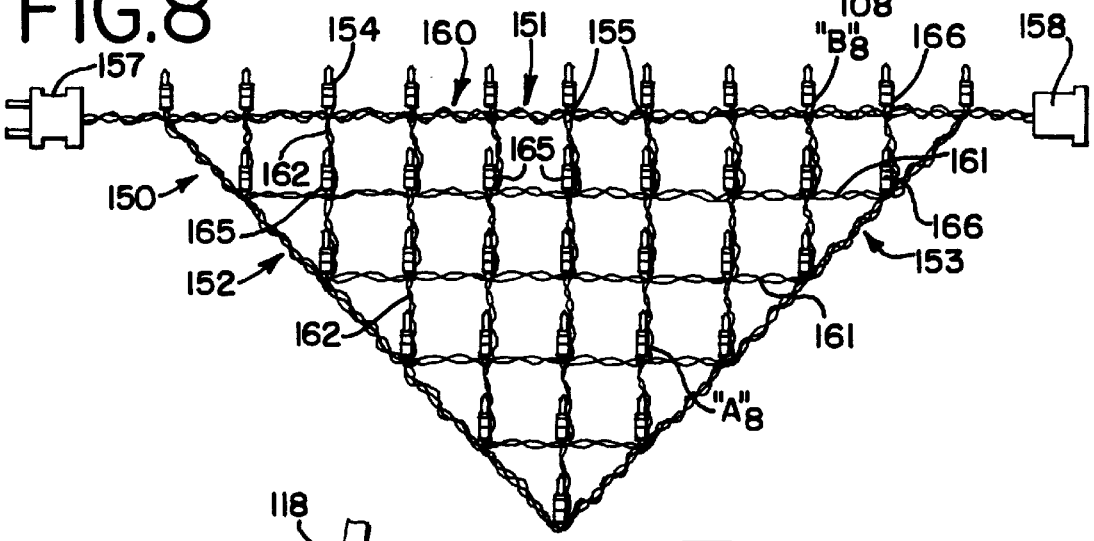
FIG. 8 is a plan view of a second embodiment of a light assembly constructed in accordance with the principles of the present invention and illustrated as having a triangular configuration.

FIG. 7 illustrates one embodiment of a decorative lighting assembly 100 having a rectangular configuration, while FIG. 8 illustrates a second embodiment of the invention in which the decorative lighting assembly 150 has a triangular configuration. The lighting assemblies of the present invention may be configured in various grids, or lattices or other similar patterns to provide a decorative array of lights that may be draped over a support member, such as a Christmas tree or the like. It will be understood that although only rectangular and triangular lighting assemblies are shown in the drawings, other similar geometric patterns may also be utilized. The lighting assembly 100 of FIG. 1 has a conventional plug 102 at one end thereof and a receptacle 104 at the other end thereof for connecting the lighting assembly 100 to a source of power, as well as to another lighting assembly.

The lighting assembly may be considered as having a baseline 105 that extends between the plug 102 and receptacle 104, and a plurality of first wire branches 106 that extend generally parallel to the baseline 105. A plurality of second wire branches 107 extend at an angle to the baseline 105 and are shown in the preferred embodiment of FIG. 7 as generally perpendicular thereto. These second wire branches 107 intersect with the base line 105 and first wire branches 106 to define a plurality of individual nodes of the lighting assembly 100. Each wire branch 106, 107 has at least two wires that are twisted together, while some portions of the baseline 105 may include three different wires twisted together. As will be understood, some of the first and second wire branches 106, 107 are made up of two separate wires twisted together (such as that illustrated in FIG. 10), whereas others of the first and second wire branches (such as that illustrated in FIG. 9) are made up of a single wire that is twisted upon itself. The three wire portions of the lighting assembly 100 are identified in FIG. 7 by the thicker shaded lines of the drawing.

The nodes of the lighting assembly may be considered as including both exterior nodes 108 that lie along the perimeter edges of the lighting assembly 100 and interior nodes 109 that lie within the perimeter of the lighting assembly 100. As shown best in FIG. 9, each such node 108, 109 includes a light socket 111 positioned therein that receives a light bulb 112. The light socket 111 has a live feed wire 114 that delivers current to it, as well as a return wire 115 from which current entering the light socket 111 may exit and travel to the next light socket. Both the feed and return wires 114, 115 enter and exit the light socket 111 from the bottom of the socket through conventional openings (not shown).

Figure 9:
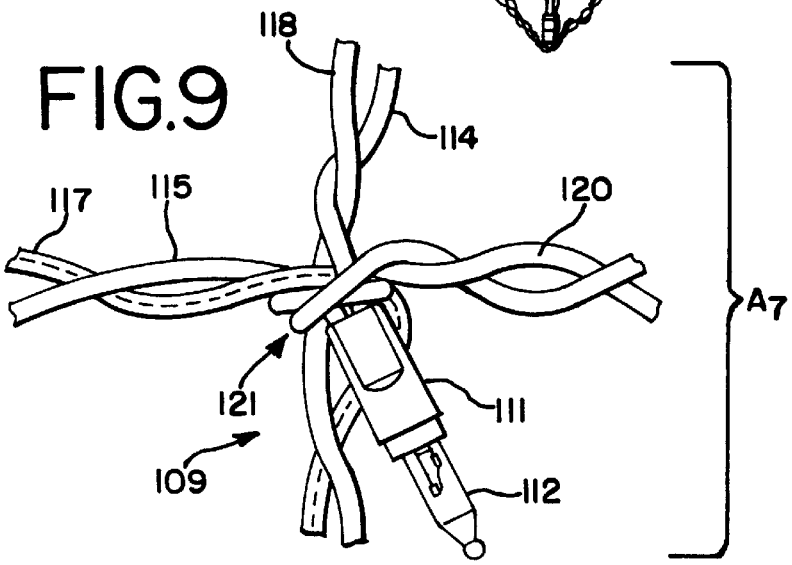
FIG. 9 is an enlarged view of one of the interior nodes designated at $A_7$ of the light assembly of FIG. 7, illustrating in detail the manner in which the wires of the intersecting branches engage each other at an interior node.
Figure 10:
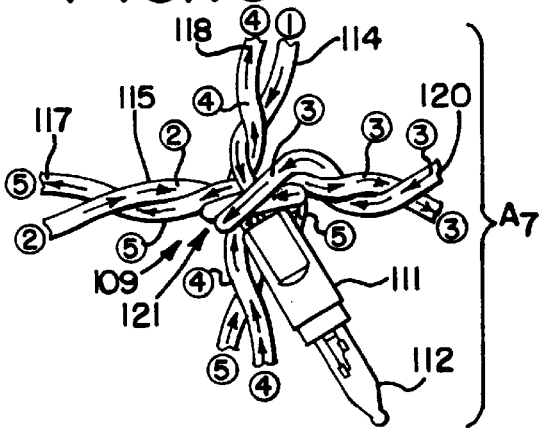
FIG. 10 is a diagrammatic view of the lighting assembly interior node of FIG. 9, illustrating the path of the various wires that enter and exit the node $A_7$.

In the preferred embodiment illustrated, the feed and return wires 114, 115 of an interior node 109 $A_7$ enter the node from different directions, with the feed wire 114 entering from above and the return wire 115 entering from the left in FIGS. 9 & 10. Two additional wires 117 & 118 enter the interior node 109 from below as illustrated in FIG. 9 and exit therefrom along the feed and return wires 114, 115. These additional wires 117, 118 are twisted together along their length prior to entering the node 109 and then after they exit the node, are twisted together with the feed and return wires 114, 115.

In order to maintain the intersection of these wires at the node 109 and proximate to the light socket 111, another additional, or tying, wire 120 is provided. This tying wire 120, enters the node 109 from the side or right as illustrated in FIG. 9, and is tied in a knot 121 around the four wires 114, 115, 117 & 118. This knot 121 lies proximate to the light socket 111 and because it encompasses all four of the node wires, significant movement of the socket 111 relative to the node 109 is substantially prevented. The knot 121 merely retains the wires together and is not joined to the light socket 111 by a mechanical element such as the sleeve shown in the prior art.

Figure 11:
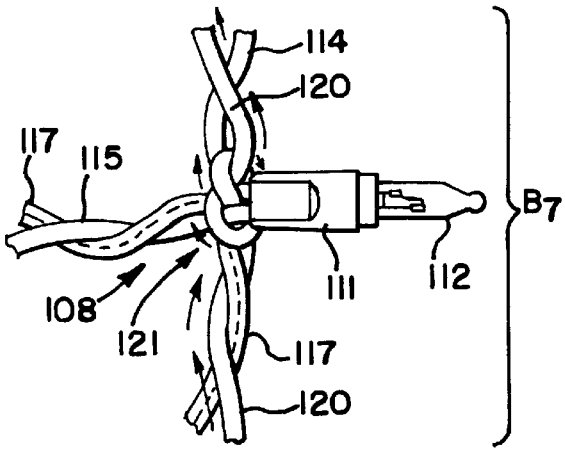
FIG. 11 is an enlarged view of one of the exterior nodes designated at $B_7$ of the light assembly of FIG. 7, illustrating in detail the manner in which the wires of the light assembly engage each other at an exterior node.

FIG. 11 illustrates, in detail, an exterior node 108 of the lighting assembly 100. In this node 108, the feed wire 114 and the return wire 115 enter and exit the light socket 11 from different directions. One additional wire 117 is provided and is paired with the return wire 115 entering the node 108 and then exits the node 109 in a different direction. The tying wire 120 in this instance extends in a knot 121 around the feed and return wires 114 & 115 proximate to the light socket 111. The tying wire 120 is further twisted together with the additional wire 117 and the feed wire 114 which inhibits any movement of the knot 121 along the axis of the return wire 115, or to the left in FIG. 11.

Turning now to FIG. 8, another lighting assembly 150 is illustrated as having a triangular configuration or lattice with three sides 151, 152 & 153 that are defined by wires and a plurality of lights 154 that are arranged at a plurality of nodes 155 of the assembly 150. The assembly 150 also has what may be considered as a baseline 160 that extends between the plug 157 and receptacle 158, and a plurality of first and second branches 161 & 162 that extend in respectively general horizontal and vertical directions when the assembly is mounted on a vertical support structure in the fashion shown in FIG. 8. The first wire branches 161 of the assembly 150 extend generally parallel to the baseline 160, while the second wire branches cross the first branches 161 and intersect therewith and the baseline to define the nodes 155 of the lighting assembly. Interior and exterior nodes 165, 166 are respectively formed in the lighting assembly 150 of FIG. 8 in a manner similar to that described for the lighting assembly 100 of FIG. 7.

Figure 12:
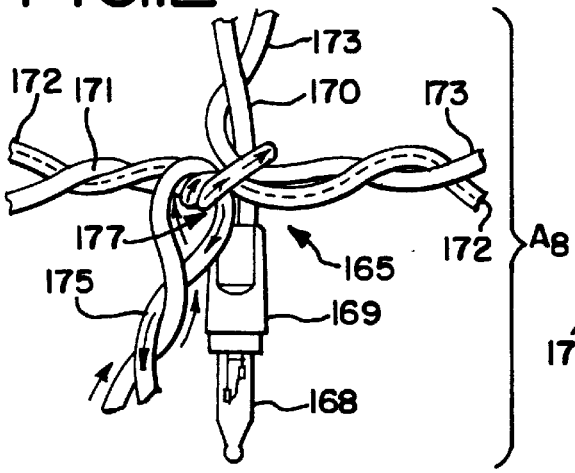
FIG. 12 is an enlarged view of one of the interior nodes designated at $A_8$ of the light assembly of FIG. 8, illustrating in detail the manner in which the wires of the intersecting branches engage each other at an interior node.

As mentioned above, each interior node 165 and exterior node 166 includes a light bulb 168 held within a light socket 169. Each such light socket 169 is fed by a live feed wire 170 and a return wire 171 which are respectively illustrated in solid black and solid white in FIG. 12. The feed wire 170 enters the interior node $A_8$ of FIG. 12 from another node disposed above the node 165, while the return wire 171 exits the node 165 horizontally at an angle to the feed wire 170.

Another pair of wires 172, 173 enters the interior node 165 from the right of the node as illustrated in FIG. 11. One of these additional wires 172 (illustrated in FIG. 12 as striped) enters from the horizontal direction on the right and exits upwardly as it is twisted with the feed wire 170. The other additional wire 173 (illustrated in FIG. 12 as dashed) also enters the node 165 from the right along a horizontal path and exits along the same path to the left of the node 165. A tying wire 175 is provided for the interior node 165 (illustrated with stippling in FIG. 12) and the tying wire enters the node 165 from the bottom along a vertical path, passes around the wires 170, 171, 172 & 173 to form an overhand knot 177 and then exits downwardly along the same path it took to the node 165. The knot 177 formed by the tying wire 175 surrounds each of the four wires 170, 171, 172 & 173 and because these wires take different directions into or away from the node 165, the knot 177 is prevented from moving along any of the axes of these four wires that form the node with the tying wire 175.

Figure 13:
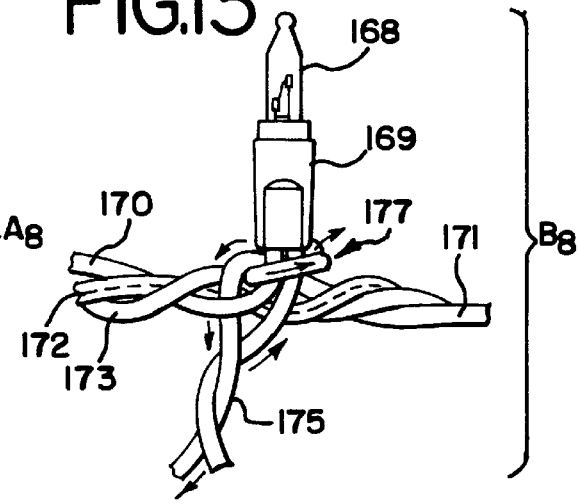
FIG. 13 is an enlarged view of one of the exterior nodes designated at $B_8$ of the light assembly of FIG. 8, illustrating in detail the manner in which the wires of the light assembly engage each other at an exterior node; and, FIG. 14 is a plan view of an alternative light assembly constructed in accordance of the principles of the present invention and having an octagonal or "spider web" configuration.

FIG. 13 illustrates in detail, an exterior node 166 that is shown at $B_8$ in FIG. 8. This exterior node 166 is similar to the interior node 165 except that it lies along one of the three sides 151–153 of the lighting assembly 150. The light socket 169 has a feed wire 170 and a return wire 171 associated therewith that may be considered as entering or leaving the node 166 along different directions. The feed and return wires 170, 171 are twisted with an additional wire 173. A tying wire 175 enters the node 166 from below as illustrated in FIG. 13 and is tied in an overhand knot 177 near the base of the light socket 169 and which further exits along the same path upon which it entered the node 166. In its exit, the tying wire 177 not only passes between the feed wire 170 and the additional wire 173 but also is twisted together with itself.

Figure 14:
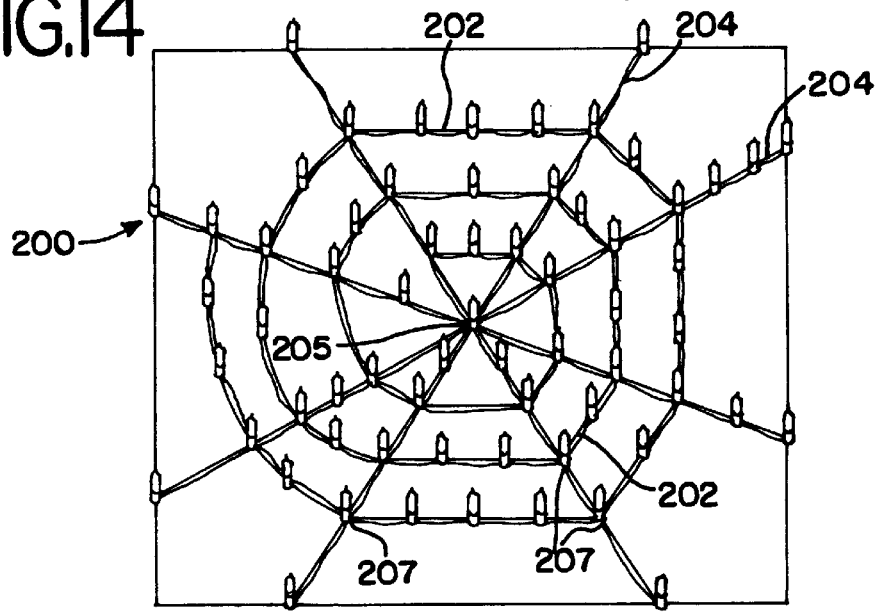

FIG. 14 illustrates, in plan view, an alternate embodiment of a light assembly 200 constructed in accordance with the principles of the present invention. The light assembly 200 has an overall octagonal or "spider-web" configuration and includes a plurality of both first wire branches 202 and second wire branches 204. The second wire branches 204 meet at the center 205 of the assembly 200, while the first wire branches 202 wind around the center 205 and intersect with the second wire branches 204 to define nodes 207 of the assembly 200.

The present invention with its novel nodal arrangement permits the use of smaller gauge wire than what would be required under UL standards for a single wire structure as shown in FIGS. 1–6. The smaller wire is less expensive and because of the presence of the tying wire and its retention knot formed at the base of the light socket, significant movement of the socket relative to the tying wire is substantially prevented. No sleeves or other mechanical devices are used to join the wires that intersect at the node to the light socket as shown in the prior art. The unique intertwining of the wires at the nodes of the present invention permits maintenance of the twisted wire pairs mandated by UL standards, thereby forming a lighting assembly in the form of a grid or lattice that meets UL standards for lighter weight and gauge wires.

While the preferred embodiments of the invention have been shown and described, it will be apparent to those skilled in the art that changes and modifications may be made therein without departing from the spirit of the invention, the scope of which is defined by the appended claims.

What is claimed is:

1. A decorative lighting assembly for displaying a plurality of electrical lights in a geometric array, comprising: a plurality of wires extending from said plug and arranged in the geometric array, said array having a plurality of individual nodes, a plug electrically connected to at least one of said wires for connecting the assembly to a source of electrical power, the array having a wire baseline extending from the plug, a plurality of first wire branches extending generally parallel to the wire baseline and a plurality of second wire branches extending from said wire baseline such that said second wire branches intersect said wire baseline and said first wire branches to form said nodes of said array, said nodes of said array including exterior and interior nodes, said exterior nodes being disposed along edges of said array and said interior nodes being disposed within the edges of said array, each of said exterior and interior nodes including a light socket associated therewith for receiving a light bulb therein, each of said light sockets being feed by a feed wire and having a return wire exiting therefrom, said interior nodes being formed by the intersection of said first and second wire branches, one of said first and second wire branches associated with each of said interior nodes being knotted around said light socket feed and return wires to form an interior node retention knot proximate to said light socket to thereby prevent any significant movement from said light socket away from said interior node.

2. The decorative lighting assembly of claim 1, wherein said geometric array has a rectangular configuration.

3. The decorative lighting assembly of claim 1, wherein said geometric array has a triangular configuration.

4. The decorative lighting assembly of claim 1, wherein said geometric array has a spider web configuration.

5. The decorative lighting assembly of claim 1, wherein said wires that make up said wire baseline and first and second wire branches are 22 gauge wires.

6. The decorative lighting assembly of claim 1, wherein said light socket feed and return wires extend from said interior nodes in different directions.

7. The decorative lighting assembly of claim 6, wherein said light socket feed and return wire different directions are angularly offset with respect to each other.

8. The decorative lighting assembly of claim 1, wherein said retention knot is formed from said first wire branches.

9. The decorative lighting assembly of claim 1, wherein some of said exterior nodes are formed by the intersection of said wire baseline and said second wire branches and the remainder of said exterior nodes are formed by the intersection of said first and second wires branches.

10. The decorative lighting assembly of claim 1, wherein said interior node retention knots are overhand knots.

11. The decorative lighting assembly of claim 1, wherein said exterior nodes each include an exterior node retention knot formed proximate to said light sockets and extending around said feed and return wires of said exterior node light sockets.

12. The decorative lighting assembly of claim 11, wherein said exterior node retention knot is an overhand knot.

13. A decorative illumination assembly, comprising: a wire lattice arranged in a predetermined pattern, the lattice having a plurality of outer edges, one of said outer edges defining a baseline of said lattice, said lattice further including a series of first branches that extend generally parallel to the baseline and a series of second branches that extend at an angle to said baseline and said first branches, the second branches intersecting said baseline and said first branches, said intersections forming interior and exterior nodes of said lattice, said exterior nodes being disposed along said lattice outer edges and said interior nodes being disposed within said lattice outer edges, each of said interior and exterior nodes having a decorative light associated therewith, said baseline and first and second branches of said lattice each being formed by two wires twisted together lengthwise of their extents, each of said interior nodes of said lattice including an interior node retention knot associated therewith formed by a tying wire, the interior node retention knot retaining said decorative light at said interior node and preventing any substantial movement of said decorative light away from said interior node, said interior node retention knot being formed by said knotting said tying wire around said first and second branch wires that form said interior node.

14. The decorative illumination assembly as set forth in claim 13, wherein said interior node retention knot is an overhand knot.

15. The decorative illumination assembly as set forth in claim 13, wherein said lattice has a rectangular configuration.

16. The decorative illumination assembly as set forth in claim 13, wherein said lattice has a triangular configuration.

17. The decorative illumination assembly as set forth in claim 13, wherein said tying wire includes one of said wires of said first and second branches.

18. The decorative illumination assembly as set forth in claim 13, wherein each of said decorative lights includes a light socket and a light bulb received within said light socket, and wherein said interior node retention knots are disposed proximate to said light sockets of said interior nodes.

19. The decorative illumination assembly as set forth in claim 18, wherein each of said light sockets include a feed wire and a return wire associated therewith and said interior node retention knots are knotted around said feed and return knots of said interior nodes.

20. The decorative illumination assembly as set forth in claim 13, wherein each of said decorative lights includes a light socket and a light bulb received within said light socket, and wherein said light sockets each include a feed wire and a return wire associated therewith that respectively enters and exits said light socket and said interior node associated therewith, said feed and return wires entering and exiting from said light socket in offset directions.

21. The decorative illumination assembly as set forth in claim 20, wherein said interior node retention knot is knotted around said feed and return wires of said interior nodes as well as said first and second branch wires intersecting at said interior node.

22. A decorative lighting assembly for draping over a support structure, comprising: a grid having a predetermined geometric shape, the grid including a plurality of electrical wires, an electrical plug for connecting the grid wires to a source of electrical power, said grid having a series of outer edges, one of said outer edges defining a baseline of said grid that extends from said plug, said grid including a series of first and second branches along which said electrical wires extend, the first branches being spaced apart from said baseline, said second branches extending in a manner so as to intersect with said baseline and said first branches to form individual interior and exterior nodes of said grid at said intersections, said exterior nodes being disposed along said grid outer edges and said interior nodes being spaced apart from and within said grid outer edges, each of said interior and exterior nodes having a light socket associated therewith, each of the light sockets having a light bulb received within said light socket, and wherein said light sockets each include a feed wire and a return wire associated therewith that respectively enters and exits said light socket and said interior node associated therewith, said feed and return wires entering and exiting said light socket in different directions, each said interior nodes of said grid including an interior node retention knot associated therewith that retains said light socket at said interior node and prevents any substantial movement of said light socket away from said interior node, said interior node retention knot being formed by a tying wire that extends around said feed and return wires of said light socket as well as said first and second branch wires intersecting at said interior node.

23. The lighting assembly of claim 22, wherein said first branches generally parallel to said baseline.

24. The lighting assembly of claim 22, wherein said second branches extend generally perpendicular to said baseline.

25. The lighting assembly of claim 24, wherein said second branches extend generally perpendicular to said first branches.

* * * * *

UNITED STATES PATENT AND TRADEMARK OFFICE

CERTIFICATE OF CORRECTION

PATENT NO. : 5,944,408

DATED : August 31, 1999

INVENTOR(S) : George Tong, et al.

It is certified that error appears in the above-identified patent and that said Letters Patent is hereby corrected as shown below:

Column 4, line13, delete "In the drawing Figures, a conventional electrical notation is used and thus the "live" or feed wire 65 of each socket is shown in solid black, while the return wire 66 is shown in solid white. Additional wires entering and leaving the nodes ar eshown in this description with stippling, dashes or stripes.

Column 6, line 41, delete "respectively".

Column 6, lines 41 and 42, delete "in solid black and solid white".

Column 6, lines 48 and 49, delete "(illustrated in FIG. 12 as striped)".

UNITED STATES PATENT AND TRADEMARK OFFICE

CERTIFICATE OF CORRECTION

PATENT NO. : 5,944,408

DATED : August 31, 1999

INVENTOR(S) : George Tong, et al.

It is certified that error appears in the above-identified patent and that said Letters Patent is hereby corrected as shown below:

Column 6, line 51, delete "(illustrated in FIG. 12 as dashed)".

Column 6, line 55, delete "(illustrated with stippling and FIG. 12)".

Signed and Sealed this

Twelfth Day of September, 2000

*Attest:*

Q. TODD DICKINSON

*Attesting Officer*

*Director of Patents and Trademarks*